United States Patent [19]

Najjar et al.

[11] Patent Number: 4,971,601

[45] Date of Patent: Nov. 20, 1990

[54] PARTIAL OXIDATION OF ASH-CONTAINING SOLID CARBONACEOUS AND/OR LIQUID HYDROCARBONACEOUS FUEL

[75] Inventors: Mitri S. Najjar, Wappingers Falls; Walter C. Gates, Jr., Carmel, both of N.Y.

[73] Assignee: Texaco Inc., White Plains, N.Y.

[21] Appl. No.: 506,138

[22] Filed: Apr. 9, 1990

Related U.S. Application Data

[63] Continuation-in-part of Ser. No. 397,945, Aug. 24, 1989.

[51] Int. Cl.[5] ..... C10J 3/46

[52] U.S. Cl. ..... 48/197 R; 48/206; 48/212; 48/215; 252/373

[58] Field of Search ..... 48/197 R, 202, 206, 48/209, 212, 215, DIG. 7; 252/373

[56] References Cited

U.S. PATENT DOCUMENTS

| | | | |
|---|---|---|---|
| 3,951,617 | 4/1976 | Crouch | 48/215 |
| 4,060,397 | 11/1977 | Buite et al. | 48/197 R |
| 4,099,383 | 7/1978 | Paull et al. | 48/197 R |
| 4,547,203 | 10/1985 | Jahnke | 48/206 |
| 4,676,805 | 6/1987 | Richter et al. | 48/206 |
| 4,889,699 | 12/1989 | Najjar et al. | 48/197 R |

*Primary Examiner*—Peter Kratz

*Attorney, Agent, or Firm*—Robert A. Kulason; James J. O'Loughlin; Albert Brent

[57] ABSTRACT

Synthesis gas, reducing gas, or fuel gas is produced by the partial oxidation of ash-containing solid carbonaceous and/or liquid hydrocarbonaceous fuel at an autogenous temperature in the range of about 20° F. to 200° F. below the softening temperature of the ash in said fuel, and at a pressure in the range of about 17 to 100 atmospheres to produce a raw effluent gas stream containing entrained carbon-rich fly-ash which is separated from the effuent gas stream. A fuel mixture comprising about 20 to 100 wt. % of said carbon-rich fly-ash and about 0 to 80 wt. % of a supplemental fuel is reacted by partial oxidation at an autogenous temperature of about 100° F. above the ash-fusion temperature, and at a reduced pressure e.g. in the range of about 1 to 16 atmospheres and at least 16 atmospheres below the pressure in the partial oxidation reaction used to produce said carbon-rich fly-ash. By reducing the pressure less carbon-rich particulate material is produced in the second partial oxidation reaction at a significant cost savings and improved process efficiency.

17 Claims, No Drawings

PARTIAL OXIDATION OF ASH-CONTAINING SOLID CARBONACEOUS AND/OR LIQUID HYDROCARBONACEOUS FUEL

This is a continuation-in-part of application Ser. No. 07/397,945, filed Aug. 24, 1989.

FIELD OF THE INVENTION

This invention relates to a partial oxidation process for producing synthesis gas, reducing gas, or fuel gas starting with a fuel feedstock comprising ash-containing solid carbonaceous and/or liquid hydrocarbonaceous fuel.

DESCRIPTION OF THE PRIOR ART

The partial oxidation of liquid hydrocarbon fuels e.g. petroleum and solid carbonaceous fuel e.g. coal to produce synthesis gas, reducing gas, and fuel gas is a well known process. These man-made gas mixtures all contain hydrogen, carbon monoxide and at least one gas from the group consisting of $H_2O$, $CO_2$, $N_2$, $H_2S$, COS, $CH_4$, and mixtures thereof. Prior to gas quenching or scrubbing the raw gas stream also contains entrained molten slag containing carbonaceous materials. Synthesis gas contains a $H_2/CO$ mole ratio which may be specified over a wide range. It is used as the gaseous feedstock for the catalytic synthesis of organic chemicals e.g. alcohol. Reducing gas is a gaseous mixture substantially comprising $H_2+CO$ and is used in metallurgical processes to effect reduction. Fuel gas is rich in $H_2$, CO and contains $CH_4$. It is used for heating. The hot raw gas stream from the partial oxidation gas generator may also contain entrained molten slag, fly-ash, and unreacted carbon-rich material. The composition of these gases depends upon actual feedstreams and the reaction conditions.

Recovering particulate carbon from raw synthesis gas and recycling the carbon in admixture with coal back to the gas generator as a portion of the feed is shown and described in coassigned U.S. Pat. No. 3,544,291, which is incorporated herein by reference. The carbon soot recovered from two gas generators is mixed with a heavy liquid hydrocarbon fuel and recycled to one of the gas generators in coassigned U.S. Pat. No. 4,411,670. However, the prior art references do not teach or suggest applicants' improved process by which the hot raw product gas streams from the partial oxidation of ash-containing solid carbonaceous and/or liquid hydrocarbonaceous fuel is cooled and separated into synthesis gas, and carbon rich fly ash in the first partial oxidation step, while molten slag and carbon-rich particulate material is produced in the second partial oxidation step. The carbon-rich fly-ash material, with or without being mixed with a supplemental fuel, is reacted by partial oxidation at in the second partial oxidation step at a substantially reduced pressure. Synthesis gas is thereby produced by the subject process containing substantially less carbon-rich particulate material at a significant cost savings and improved process efficiency.

SUMMARY OF THE INVENTION

This invention relates to an improved partial oxidation process for producing synthesis gas, reducing gas or fuel gas from ash-containing solid carbonaceous and/or liquid hydrocarbonaceous fuel comprising the steps of:

(1) reacting said fuel feedstock by partial oxidation with a free-oxygen containing gas and a temperature moderator in a free-flow vertical refractory-lined gas generator at an autogenous temperature in the range of about 20° F. to 200° F. below the softening temperature of the ash in said fuel, in a reducing atmosphere, a pressure in the range of about 17 to 100 atmospheres, an OC atomic ratio in the range of about 0.6 to 1.4, and a weight ratio of $H_2O$ to carbon in the fuel feedstock in the range of about 0.3 to 4.0, to produce a raw gas stream comprising synthesis gas, reducing gas, or fuel gas with entrained carbon-rich fly-ash;

(2) separating said carbon-rich fly-ash from said raw gas stream;

(3) reacting a fuel comprising from about 20 to 100 wt. % of said carbon-rich fly-ash and about 0 to 80 wt.% of a supplemental fuel selected from the group consisting of liquid hydrocarbonaceous fuel, coal, coke from coal, petroleum coke, oil shale, tar sands, asphalt, pitch, and mixtures thereof by partial oxidation with a free-oxygen containing gas and a temperature moderator in a free-flow vertical refractory-lined gas generator at an autogenous temperature in the range of at least about 100° F. above the fluid temperature of the slag produced, in a reducing atmosphere, a pressure in the range of about 1 to 16 atmospheres and at least 16 atmospheres below the pressure in the gas generator in (1), an O/C atomic ratio in the range of about 0.6 to 13, and a weight ratio of $H_2O$ to fuel in the range of about 0.1 to 5.0, to produce a raw product gas stream comprising synthesis gas, reducing gas, or fuel gas with entrained molten slag and containing less carbon-rich particulate material than that which would be produced if said fuel is reacted by partial oxidation at substantially the same operating conditions as those in the gas generator in (3) except for a higher pressure which is in the range of about 17 to 100 atmospheres; and (4) cooling said raw gas stream from (3).

For example, the fuel feedstock in step (1) may be bituminous coal. The fuel in step (3) may comprise 20 to 100 wt.% of carbon-rich fly-ash produced in step (1), and the remainder of the fuel in step (3) e.g., about 0 to 80 wt.%., comprises bituminous coal.

DESCRIPTION OF THE INVENTION

Synthesis gas, reducing gas and fuel gas comprising mixtures of $H_2$, CO and various amounts of other gases may be made by the partial oxidation process, such as described in coassigned U.S. Pat. Nos. 3,544,291, 3,607,157, 3,998,609 and 4,289,502, which are incorporated herein by reference. Advantageously, the partial oxidation process may use as feedstock comparatively low-cost readily available ash-containing solid carbonaceous fuels and/or liquid hydrocarbonaceous fuels. For example, the following ash-containing solid carbonaceous fuels may be used as the starting fuel feedstock in the subject process: coal i.e. anthracite, bituminous, subbituminous, or lignite; coke from coal; petroleum coke; oil shale; tar sands; asphalt; pitch; and mixtures thereof.

The term ash-containing liquid hydrocarbonaceous fuel, as used herein is intended to include various materials, such as virgin crude, residue from petroleum distillation and cracking, petroleum distillates, reduced crude, whole crude, asphalt, coal tar, coal derived oil, shale oil, tar sand oil and mixtures thereof. The sulfur and ash contents of the heavy liquid hydrocarbonaceous fuel are respectively in the ranges of about 0.5 to 5.0 weight %; and 100 to 10,000 parts per million. Ash from heavy liquid hydrocarbonaceous fuel substantially comprises the oxides and some sulfides of Fe, Ni, V and Si.

It was generally believed that the amount of carbon conversion for any of the solid fuels increased as the gasification temperature and pressure are increased. For example, the steam and $CO_2$ reactions with carbon to produce CO and $H_2$ increase with pressure and temperature. However, it was unexpectedly found that by the subject process, carbon conversion is increased with decreasing pressure. Advantageously, it is more economical to operate a gas generator at a lower pressure. Further, a greater amount of product gas is produced containing substantially less carbon-rich particulate material.

The term bituminous coal, as used herein, refers to Class II Bituminous Coal Groups 1 to 5 ASTM D 388-66.

In the subject partial oxidation process, ground ash-containing carbonaceous fuel and/or liquid hydrocarbonaceous fuel may be introduced into the gas generator either alone or in the presence of a substantially thermally vaporizable hydrocarbon and/or water, or entrained in a temperature moderator such as steam, $CO_2$, $N_2$ or recycle synthesis gas. The term and/or is used herein in its usual way. For example, A and/or B means a material selected from the group A, B, and mixtures thereof. The particle size of the solid carbonaceous fuel supplied to the gas generator is such that 100% passes through an ASTM E11-70 Sieve Designation Standard (SDS) 140 mm Alternative No. 14, such as about 425 um Alternative No. 40.

An annular-type burner is used to introduce the fuel feedstock into the gasifier. Suitable annular-type burners are shown and described in coassigned U.S. Pat. Nos. 3,847,564; 4,364,744; and 4,525,175, which are incorporated herein by reference. The burner is located in the top of the gas generator along the central vertical axis. A typical down-flowing free-flow unobstructed vertical refractory lined partial oxidation synthesis gas generator is shown in coassigned U.S. Pat. No. 2,818,326, which is incorporated herein by reference.

The term free-oxygen containing gas, as used herein is intended to include air, oxygen-enriched air, i.e. greater than 21 mole % oxygen, and substantially pure oxygen i.e. greater than 95 mole % oxygen (the remainder comprising $N_2$ and rare gases). Free oxygen containing gas may be introduced into the burner at a temperature in the range of about ambient to 1000° F.

The use of a temperature moderator to moderate the temperature in the reaction zone of the gas generator depends in general on the carbon to hydrogen ratio of the feedstock and the oxygen content of the oxidant stream. Suitable temperature moderators include steam, water, $CO_2$-rich gas, liquid $CO_2$, recycle synthesis gas, a portion of the cooled clean exhaust gas from a gas turbine employed downstream in the process, by-product nitrogen from the air separation unit used to produce substantially pure oxygen, and mixtures of the aforesaid temperature moderators. Water serves as the carrier and the temperature moderator with slurries of solid carbonaceous fuel. However, steam may be the temperature moderator with slurries of liquid hydrocarbon fuels and solid carbonaceous fuel. The temperature moderator may be introduced into the gas generator in admixture with either the solid carbonaceous fuel feed, the free-oxygen containing gas stream, or both. Alternatively, the temperature moderator may be introduced into the reaction zone of the gas generator by way of a separate conduit in the fuel burner. When $H_2O$ is introduced into the gas generator either as a temperature moderator, a slurrying medium, or both, the weight ratio of $H_2O$ to fuel is in the range of about 0.1to 5 and preferably in the range of about 0.2 to 1.0.

The relative proportions of solid carbonaceous fuel, liquid hydrocarbon fuel if any, water or other temperature moderator, and oxygen in the feed streams to gas generator, are carefully regulated to convert a substantial portion e.g. 75 to 95 wt. %, such as 80 to 90 wt. % of the carbon in the fuel feed to the partial oxidation gas generator to carbon oxides e.g. CO and $CO_2$; and, to maintain an autogenous reaction zone temperature of about 20° F. to 200° F. below the softening temperature of the ash in the fuel feedstock when the first partial oxidation reaction takes place in the fly-ash mode e.g., below about 2000° F.; and in the range of at least about 100° F. above the fluid temperature of the slag produced in the second partial oxidation reaction zone e.g. above about 2200° F. Reference is made to ATM D 1857 for suitable standard test methods for determining softening and fluid temperatures. In the first partial oxidation reaction, the pressure in the reaction zone is in the range of about 17 to 100 atmospheres, and the atomic ratio of free-oxygen in the oxidant to carbon in the fuel feedstock (O/C atom/atom) is in the range of about 0.7 to 1.6. The time in the reaction zone of the partial oxidation gas generator in seconds is in the range of about 0.5 to 10, such as normally about 1.0 to 5. Reaction takes place in a reducing atmosphere.

The effluent gas stream leaving the partial oxidation gas generator has the following composition in mole % : $H_2$ 8.0 to 60.0, CO 8.0 to 70.0, $CO_2$ 1.0 to 50.0, $H_2O$ 2.0 to 50.0, $CH_2$ 0.0 to 2.0, $H_2S$ plus COS 0.10 to 2.0, $N_2$ 0.0 to 80.0, and A 0.0 to 2.0. Trace amounts of the following gaseous impurities may be also present in the effluent gas stream in parts per million (ppm): HCN 0 to 100; such as about 2 to 20; HCl 0 to about 20,000, such as about 200 to 2,000; and $NH_3$ 0 to about 10,000, such as about 100 to 1000. Entrained in the effluent gas stream is about 15 to 80 wt. such as 20 to 40 wt. %, of porous carbon-rich fly-ash material (basis weight of carbon in the feed to the gas generator). Fly-ash is the unmolten remnant of partially combusted particles of the fuel feedstock. On a dry basis, the carbon-rich fly-ash particles may comprise about 15–80 wt. percent carbonaceous material and the remainder (in the amount of about 20–85 wt.%) may comprise in Wt.%: $SiO_2$ 10–60; $Al_2O_3$ 8–45; iron oxides and sulfides 2–50, calcium oxides, silicates, aluminum nitrates and sulfides 0–40, and others. The carbon-rich fly-ash particles in the hot raw gas stream have a particle size in the range of about 0.1 to 1000 microns. The content of mineral matter in the fuel feedstock is about 5 to 20 wt. %.

At least a portion e.g. about 20 to 100 volume % of the effluent gas stream leaving the reaction zone of partial oxidation gas generator is passed through the unobstructed central axial passage at the bottom of the reaction zone.

The hot raw effluent gas stream exits from the partial oxidation gas generator and may be cooled to a temperature in the range of about 60° to 950° F., such as less than about 350° F. For example, the hot gas stream may be first partially cooled by direct contact with water contained in a quench tank, such as shown in coassigned U.S. Pat. No. 4,218,423, which is incorporated herein by reference. Fly-ash material is cooled by the quench water and transferred to the water in the quench tank.

The partially cooled gas stream may be then passed through a water scrubbing operation to remove any remaining entrained particulate matter. The pressure in the quench tank is substantially the same as the gas generator located above. A portion of the quench water at the bottom of the quench tank is removed by way of a lockhopper system and settler, such as shown in coassigned U.S. Pat. No. 3,607,157. Another stream of quench water carrying fine particles exits the gasifier quench chamber in response to a liquid level controller and is directed to a settler. Clarifier bottoms or tops are separated from the water and have a composition similar to the previously described carbon-rich particulate matter. Alternatively, the hot raw effluent gas stream from the reaction zone may be partially cooled, by indirect heat exchange, prior to being scrubbed with water, by being passed through a radiant or convection gas cooler. For example, see coassigned U.S. Pat. Nos. 2,931,715; 4,081,253; and 4,377,132; which are incorporated herein by reference. Carbon-rich fly-ash material may pass from the water sump of the gas cooler and be collected in a lock hopper vessel. The solids and water from the lock hopper may then flow by gravity into a water sump or settler where the fly-ash material is removed. For example, a portion of the quench water at the bottom of the quench tank 26 is removed by way of a lockhopper 37 and settler 40 as shown in the drawing for coassigned U.S. Pat. No. 3,544,291, which is incorporated herein by reference. The aqueous suspensions of carbon-rich flyash in lines 39, 41 and 42 of U.S Pat. No. 3,544,291 have solids concentrations in the range of about 1.0 to 50.0 wt. %, such as about 10 to 20 wt. %. For example, the overflow stream in line 41 of the drawing in coassigned U.S. Pat. No. 3,544,291 may have a solids content of carbon-rich fly-ash particulate matter in the range of about 1.0–4.0 wt. %. Conventional solids-liquid separators e.g. screens may be used to recover the solid fly ash particles from the water. It was unexpectedly found that increased carbon conversion can be obtained when the carbon-rich particulate fly-ash either by itself or in admixture with a supplemental fuel is subjected to the partial oxidation process in the slagging mode at a pressure which is less than that in the partial oxidation gasifier used to produce said carbon-rich fly-ash particulate material starting with ash-containing solid carbonaceous and/or liquid hydrocarbonaceous fuel.

A fuel mixture for the second partial oxidation reaction is prepared comprising about 20 to 100 wt. %, such as about 25 to 90 wt.%, of said carbon-rich fly-ash material; and the remainder in the amount of about 0 to 80 wt.%, comprising a supplemental fuel selected from the group consisting of an ash-containing solid carbonaceous fuel and/or a liquid hydrocarbonaceous fuel as described previously. A mixture of said solid carbonaceous fuels, for example preferably bituminous coal in admixture with said carbon-rich particulate material may be introduced into a partial oxidation gas generator as an aqueous slurry having a solids content in the range of about 30–65 wt. %, or alternatively as crushed solid fuel mixture entrained in a gaseous medium selected from the group consisting of steam, recycle portion of the product gas, $CO_2$, $N_2$, and mixtures thereof. The fuel mixture is introduced into a free-flow unobstructed noncatalytic vertical refractory-lined partial oxidation gas generator along with a free-oxygen containing gas and a temperature moderator by means of a burner, in the manner previously described. The $H_2O$/fuel wt. ratio is substantially in the same range as previously described in the first partial oxidation step. Advantageously, because of the high reactivity of the carbon-containing material, the O/C atomic ratio may be reduced in the second partial oxidation reaction for example, to a value in the range of about 0.6 to 1.3.

The second partial oxidation reaction takes place in a reducing atmosphere at an autogenous temperature in the range of at least about 100° F. above the fluid temperature of the slag produced in the second partial oxidation reaction, and at a reduced pressure in the range of about to 16 atmospheres and at least 16 atmospheres below the pressure in the first partial oxidation step in which the first carbon-rich fly-ash material was produced. A raw product gas stream comprising synthesis gas, reducing gas, or fuel gas having a composition substantially as previously described and containing entrained molten slag and less carbon-containing particulate material than that which would be produced if said fuel mixture is reacted by partial oxidation at substantially the same operating conditions as in the second partial oxidation reaction step except for a higher pressure, which pressure is in the same range as that in the first partial oxidation reaction step e.g. about 17 to 100 atmospheres. For example, from about 15.0 to 80.0 wt. % of carbon-rich fly-ash (basis weight of carbon in fuel feedstock to first partial oxidation step) is produced during the first partial oxidation step. In contrast, from about 0.01 to 2.0 wt. % of carbon-rich particulate material (basis weight of carbon in all of the fuel fed to the second partial oxidation step) is produced during the second partial oxidation step with a fuel feed comprising carbon-rich particulate material produced in the first partial oxidation step with or without admixture with fresh supplemental fuel. Accordingly, by the subject process in the second partial oxidation step more carbon is converted into carbon oxides at a greater process efficiency. For example, less oxygen is consumed in the second partial oxidation step to convert the same amount of carbon as that converted in the first partial oxidation step into synthesis gas. Further, substantial cost savings are effected by the subject process since costs for oxygen and for cleaning the process gas stream are reduced.

The hot raw gas stream is cooled by quenching in water and/or by indirect heat exchange in a radiant and/or convection cooler. Slag is separated from the raw gas stream.

In another embodiment, an additive selected from the group consisting of iron-containing material, copper-containing material, calcium-containing material, and mixtures thereof is introduced into the gas generator in the first partial oxidation step. Removal of sulfur-containing gases and/or molten slag, including vanadium laths and spinels as found in the fuel feedstock, from the refractory lined reaction zone is thereby facilitated. For example, from about 1 to 10 parts by weight of additive, such as about 0.1to 5 parts by weight of additive are used for each part by weight of ash in the fuel feedstock. For example, see coassigned U.S. Pat. Nos. 4,668,428; 4,668,429; 4,657,698; 4,732,700; and 4,826,627, which are incorporated herein by reference.

During the first partial oxidation reaction most of the aforesaid additive e.g. greater than 80 wt.% goes into the fly-ash and is therefore available to facilitate removal of sulfur-containing gases and/or molten slag in the second partial oxidation stage.

The process of the invention has been described generally and by examples with reference to materials of particular composition for purposes of clarity and illustration only. It will be apparent to those skilled in the art from the foregoing that various modifications of the process and materials disclosed herein can be made without departure from the spirit of the invention.

We claim:

1. A partial oxidation process for producing synthesis gas, reducing gas or fuel gas from a fuel feedstock comprising ashcontaining solid carbonaceous and/or liquid hydrocarbonaceous fuel comprising the steps of:

(1) reacting said fuel feedstock by partial oxidation with a free-oxygen containing gas and a temperature moderator in a free-flow vertical refractory-lined gas generator at an autogenous temperature in the range of about 20° F. to 200° F. below the softening temperature of the ash in said fuel, a pressure in the range of about 17 to 100 atmospheres, an O/C atomic ratio in the range of about 0.6 to 1.4, and a weight ratio of $H_2O$ to carbon in the fuel feedstock in the range of about 0.3 to 4.0, to produce a raw gas stream comprising synthesis gas, reducing gas, or fuel gas with entrained carbon-rich fly-ash;

(2) separating said carbon-rich fly-ash from said raw gas stream;

(3) reacting a fuel comprising from about 20 to 100 wt. % of said carbon-rich fly-ash and about 0 to 80 wt.% comprising a supplemental fuel comprising ash-containing solid carbonaceous and/or liquid hydrocarbonaceous fuel by partial oxidation with a free-oxygen containing gas and a temperature moderator in a free-flow vertical refractory-lined gas generator at an autogenous temperature in the range of at least about 100° F. above the fluid temperature of the slag produced, a pressure in the range of about 1 to 16 atmospheres and at least 16 atmospheres below the pressure in the gas generator in (1), an O/C atomic ratio in the range of about 0.6 to 1.3, and a weight ratio of $H_2O$ to fuel in the range of about 0.1 to 5.0, to produce a raw product gas stream comprising synthesis gas, reducing gas, or fuel gas with entrained molten slag and containing less carbon-rich particulate material than that which would be produced if said fuel is reacted by partial oxidation at substantially the same operating conditions as those in the gas generator in (3) except for a higher pressure which is in the range of about 17 to 100 atmospheres; and (4) cooling said raw gas stream from (3).

2. The process of claim 1 wherein said solid carbonaceous fuel (1) is introduced into the gas generator as an aqueous slurry having a solids content in the range of about 30–65 wt. %, or alternatively as crushed solid carbonaceous fuel entrained in a gaseous medium selected from the group consisting of steam, recycle portion of the product gas, $CO_2$, $N_2$, and mixtures thereof.

3. The process of claim 2 wherein said solid carbonaceous fuel has a particle size such that 100% passes through an ASTM E11-70 Sieve Designation Standard (SDS) 1.40 mm Alternative No. 14.

4. The process of claim 1 provided with the steps of quench cooling of the raw gas stream from (1) in a pool of quench water whereby said carbon-rich fly-ash is separated from the raw gas stream; separating said carbon-rich fly-ash from water in a settler or clarifier and mixing together the carbon-rich fly-ash with said supplemental fuel to provide a fuel for reacting in (3).

5. The process of claim 1 provided with the steps of cooling the raw gas stream from (1) by passing it through a radiant and/or convection gas cooler followed by scrubbing the gas stream with water; whereby, said carbon-rich fly-ash is separated from the raw gas stream; separating said carbon-rich fly ash from water in a settler or clarifier; and mixing together the carbon-rich fly-ash with said supplemental fuel to provide a fuel for reacting in (3).

6. The process of claim 1 wherein the partial oxidation reactions in (1) and (3) take place in the same or different gas generators.

7. The process of claim 1 wherein about 5.0 to 30.0 wt. % of carbon-rich fly-ash (basis weight of carbon in fuel feedstock) is produced in (1) and about 0.01 to 4.0 wt.% of carbon-rich fly-ash (basis weight of carbon in fuel fed to gas generator in (3)) is produced in (3).

8. The process of claim 1 wherein the fuel reacted in (3) is introduced into the gas generator as an aqueous slurry having a solids content in the range of about 30–65 wt. %, or alternatively as crushed fuel entrained in a gaseous medium selected from the group consisting of steam, recycle portion of the product gas, $CO^2$, $N_2$, and mixtures thereof.

9. The process of claim 1 provided with the step of introducing an additive into the gas generator in (1) to facilitate the removal of sulfur-containing gases and/or to raise the ash-fusion temperature of ash in the feed.

10. The process of claim 9 wherein from about 0.05 to 10 parts by weight of additive are introduced into the gas generator in (1) for each part by weight of ash in the fuel feedstock.

11. The process of claim 9 wherein said additive is selected from the group consisting of iron-containing material, copper-containing material, calcium-containing material, and mixtures thereof.

12. The process of claim 10 wherein said additives are introduced to remove sulfur.

13. The process of claim 9 wherein said additive is selected from the group consisting of aluminum-containing material, magnesium-containing material, titanium-containing material, silicon-containing material, and mixtures thereof.

14. The process of claim 13 wherein said additives are introduced to raise the ash-fusion temperature of the ash in the fuel feed.

15. The process of claim 1 wherein the fuel feedstock in (1) and the supplemental fuel in (3) is an ash-containing solid carbonaceous fuel selected from the group consisting of coal i.e. anthracite, bituminous, subbituminous, or lignite; coke from coal; petroleum coke; oil shale; tar sands; asphalt; pitch; and mixtures thereof.

16. The process of claim 1 wherein the fuel feedstock in (1) and the supplemental fuel in (3) is an ash-containing liquid hydrocarbonaceous fuel selected from the group consisting of virgin crude, residue from petroleum distillation and cracking, petroleum distillates, reduced crude, whole crude, coal tar, coal derived oil, shale oil, tar sand oil and mixtures thereof.

17. A partial oxidation process for producing synthesis gas, reducing gas or fuel gas from an ash-containing fuel feedstock comprising bituminous coal comprising the steps of:

(1) reacting said fuel feedstock by partial oxidation with a free-oxygen containing gas and a temperature moderator in a free-flow vertical refractory-lined gas generator at an autogenous temperature in the range of about 20° F. to 200° F. below the softening temperature of the ash in said fuel, a pressure in the range of about 17 to 100 atmospheres, an O/C atomic ratio in the range of about 0.6 to 1.4, a weight ratio of $H_2O$ to carbon in the fuel feedstock in the range of about 0.3 to 4.0, to produce a raw gas stream comprising synthesis gas, reducing gas, or fuel gas with entrained carbon-rich fly-ash;

(2) separating said carbon-rich fly-ash from said raw gas stream;

(3) reacting a fuel comprising from about 25 to 90 wt. % of said carbon-rich fly-ash and about 10 to 75 wt.% of bituminous coal by partial oxidation with a free-oxygen containing gas and a temperature moderator in a free-flow vertical refractory-lined gas generator at an autogenous temperature in the range of about 100° F. above the fluid temperature of the slag produced, a pressure in the range of about 1 to 16 atmospheres and at least 16 atmospheres below the pressure in the gas generator in (1), an O/C atomic ratio in the range of about 0.6 to 1.3, and a weight ratio of $H_2O$ to bituminous coal in the range of about 0.1 to 5.0, to produce a raw product gas stream comprising synthesis gas, reducing gas, or fuel gas with entrained molten slag and containing less carbon-rich particulate material than that which would be produced if said fuel is reacted by partial oxidation at substantially the same operating conditions as those in the gas generator in (3) except for a higher pressure which is in the range of about 17 to 100 atmospheres; and (4) cooling said raw gas stream from (3).

* * * * *

UNITED STATES PATENT AND TRADEMARK OFFICE

CERTIFICATE OF CORRECTION

PATENT NO. : 4,971,601

DATED : November 20, 1990

INVENTOR(S) : MITRI S. NAJJAR ET AL

It is certified that error appears in the above-identified patent and that said Letters Patent is hereby corrected as shown below:

Column 8:

Claim 8, Line 26 change "$CO^2$" to --$CO_2$--

Signed and Sealed this

Twenty-eighth Day of July, 1992

*Attest:*

DOUGLAS B. COMER

*Attesting Officer*

*Acting Commissioner of Patents and Trademarks*